US012344427B2

(12) United States Patent
Ponti

(10) Patent No.: US 12,344,427 B2
(45) Date of Patent: Jul. 1, 2025

(54) MACHINE AND METHOD FOR PACKAGING ARTICLES BY WRAPPING

(71) Applicant: C.M.C. S.P.A., Città di Castello (IT)

(72) Inventor: Giuseppe Ponti, Città di Castello (IT)

(73) Assignee: C.M.C. S.P.A., Città di Castello (IT)

( * ) Notice: Subject to any disclaimer, the term of this patent is extended or adjusted under 35 U.S.C. 154(b) by 28 days.

(21) Appl. No.: 17/927,605

(22) PCT Filed: May 24, 2021

(86) PCT No.: PCT/IB2021/054488
§ 371 (c)(1),
(2) Date: Nov. 23, 2022

(87) PCT Pub. No.: WO2021/240342
PCT Pub. Date: Dec. 2, 2021

(65) Prior Publication Data

US 2023/0166878 A1 Jun. 1, 2023

(30) Foreign Application Priority Data

May 28, 2020 (IT) ..... 102020000012661

(51) Int. Cl.
*B65B 9/067* (2012.01)
*B65B 41/16* (2006.01)
(Continued)

(52) U.S. Cl.
CPC ..... *B65B 9/067* (2013.01); *B65B 41/16* (2013.01); *B65B 49/16* (2013.01); *B65B 51/023* (2013.01); *B65B 59/001* (2019.05); *B65B 61/06* (2013.01)

(58) Field of Classification Search
CPC ..... B65B 61/06; B65B 51/023; B65B 49/16; B65B 41/16; B65B 59/001; B65B 9/067
See application file for complete search history.

(56) References Cited

U.S. PATENT DOCUMENTS 4,430,844 A * 2/1984 James ..... B65B 61/12 53/550
4,506,488 A * 3/1985 Matt ..... B65B 57/00 53/550

(Continued)

FOREIGN PATENT DOCUMENTS

EP 1689642 A1 8/2006
WO 2005035367 A1 4/2005

OTHER PUBLICATIONS

International Search Report and the Written Opinion of the International Searching Authority, issued in corresponding International Application No. PCT/IB2021/054488, dated Sep. 2, 2021, 11 pages.

*Primary Examiner* — Anna K Kinsaul
*Assistant Examiner* — Himchan Song
(74) *Attorney, Agent, or Firm* — Rothwell, Figg, Ernst & Manbeck, P.C.

(57) ABSTRACT

A packing machine (M) and method for wrapping a sheet (P), in particular of shock-absorbing paper, around articles (A) so as to form bags (B) with means (4,5) for folding the said sheet around the articles and means (6) for gluing the said sheet to itself so as to create a sheet tube (TB) around the articles (A) and compression and cutting means (7), for sealing and separating portions of the tube by sealing and separating the ends upstream and downstream of the article, acting in cooperation with second glue application means (10) on the sheet at the cutting areas, located upstream of the sheet folding and gluing means.

16 Claims, 7 Drawing Sheets

(51) Int. Cl.

| | |
|---|---|
| ***B65B 49/16*** | (2006.01) |
| ***B65B 51/02*** | (2006.01) |
| ***B65B 59/00*** | (2006.01) |
| ***B65B 61/06*** | (2006.01) |

(56) References Cited

U.S. PATENT DOCUMENTS

| | | | | | |
|---|---|---|---|---|---|
| 4,549,386 | A | * | 10/1985 | Wilson | B29C 66/4322 53/550 |
| 4,956,963 | A | * | 9/1990 | Johnson | B65B 9/073 156/203 |
| 5,070,679 | A | * | 12/1991 | Lakey | B65B 35/24 53/553 |
| 5,255,495 | A | * | 10/1993 | Kovacs | B65B 59/001 53/550 |
| 5,402,624 | A | * | 4/1995 | Suga | B65B 49/16 53/550 |
| 5,921,067 | A | * | 7/1999 | Fujiwara | B65B 51/062 53/550 |
| 5,941,052 | A | * | 8/1999 | Evangelisti | B65B 51/303 53/511 |
| 2007/0131739 | A1 | * | 6/2007 | Ponti | B65D 75/46 229/87.01 |
| 2009/0301037 | A1 | * | 12/2009 | Franzaroli | B65B 35/40 53/461 |
| 2018/0141686 | A1 | * | 5/2018 | Christman | B65B 9/067 |

* cited by examiner

MACHINE AND METHOD FOR PACKAGING ARTICLES BY WRAPPING

CROSS REFERENCE TO RELATED APPLICATION(S)

This application is a 35 U.S.C. § 371 National Phase Entry Application from PCT/IB2021/054488, filed May 24, 2021, designating the United States, and also claims the benefit of Italian Application No. 102020000012661, filed May 28, 2020, the disclosures of which are incorporated herein by reference in their entirety.

The present invention relates to a machine for packaging articles by means of wrapping. In particular, the present invention relates to a machine suitable for wrapping a sheet of paper material, in particular a multi-ply sheet and in particular formed of at least one layer of packaging paper and one layer of embossed paper, the said layer being glued to the previous one to form a sheet which can absorb shocks, wrapped around articles so as to form closed bags containing individual articles.

There are commonly known machines which wrap a film around an article so as to form a closed bag made of a heat-sealable plastic material. These are commonly called "cellophane wrapping machines" since the film used for packaging is usually cellophane. Cellophane wrapping machines are commonly known for the packaging of individual articles, but they must be stopped and reassembled if one wishes to perform a type change, in particular due to a different sized article to be wrapped. Patent application IT102018000011148 (which has not yet been published at the time of filing this application) describes a bagging machine designed to overcome this problem by allowing the bagging of different sized articles, fed continuously along the same line. The material can be any heat-sealable film, including therein shock-absorbing films, for example the wrapping material commonly known as "bubble wrap". For various reasons, in particular for environmental and economic reasons, it would however be desirable to use a different type materials rather than the plastic materials that the aforesaid machines used. Indeed, there is an increasing tendency to prefer (especially following the introduction of specific legislative provisions) paper materials such as cardboard and paper for packaging and bagging. These may also be shock-absorbing materials and can have a lower environmental impact, as well as being lighter, colourable, and directly printable.

It would therefore be desirable to use paper material for bagging articles, including different types of articles, in the same machine and in the same operating cycle, without needing to stop the machine to adapt it to different articles but rather feeding these articles to the machine regardless of the different types and sizes thereof.

These drawbacks have now been overcome by means of a packaging machine according to claim 1 appended hereto and a method according to claim 15 appended hereto.

Further preferred characteristics of the packaging machine according to the present invention are set out in the dependent claims.

One preferred embodiment of the invention is now described by way of example, with the aid of the accompanying figures, in which.

Figure 1:
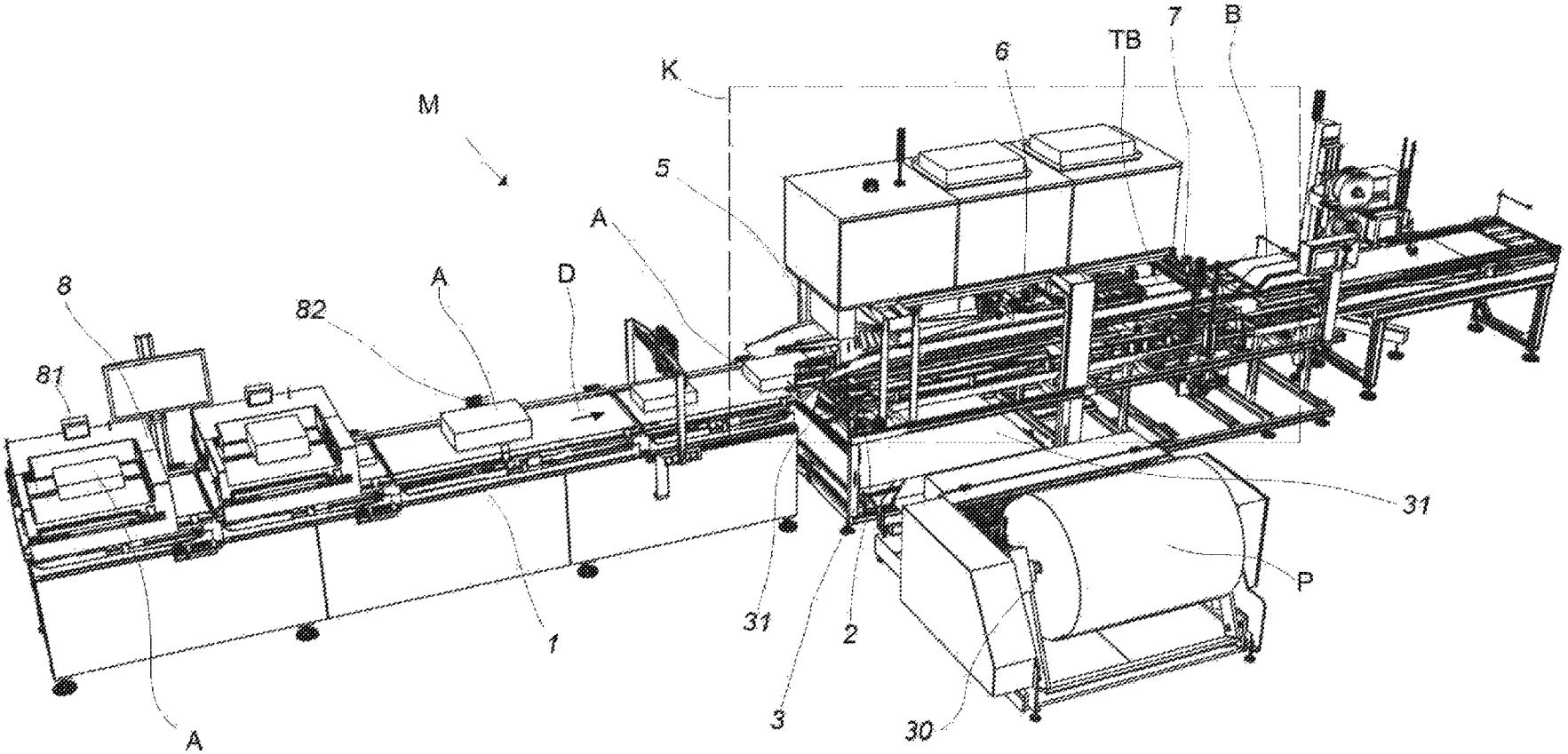
FIG. 1 shows, schematically, a perspective view of a machine according to the present invention.

With reference to the accompanying figures, in particular FIG. 1, M denotes—as a whole—the packaging machine suitable for wrapping a sheet P around articles A so as to form bags B containing individual articles, according to the present invention.

Figure 2:
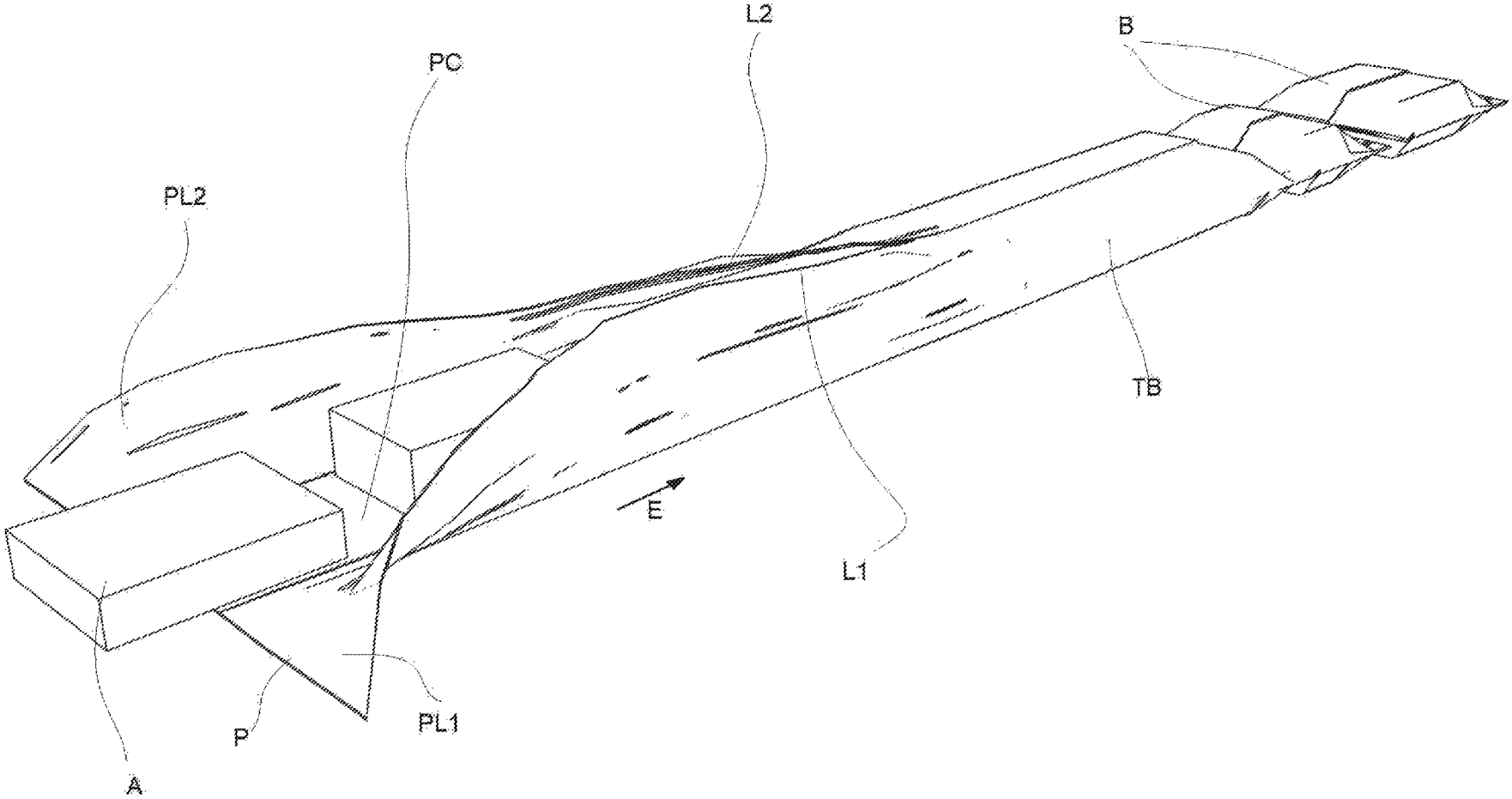
FIG. 2 shows, schematically, the steps involved in wrapping a sheet of paper around the articles so as to form bags containing individual articles, as performed by the machine in FIG. 1.

The machine M includes: conveying means 1 suitable for receiving and conveying articles A (which must be packaged) in a conveying direction shown by the arrow D; a vacuum conveyor belt 2, which is arranged consecutively to the conveying means 1; a sheet P feeding station 3, comprising, for example, a reel 30 onto which the said sheet P is wound in the form of a web and feeding and return means 31 for feeding the sheet P between the conveying means 1 and the conveyor belt 2, transversely to the direction of conveying D of the articles A, and to convey the sheet P with a central part PC (as shown in FIG. 2) resting on the conveyor belt 2 and with lateral parts PL1 and PL2 arranged on the two opposite sides of the central part PC so that they are protruding laterally from the conveyor belt 2, so that the articles A conveyed by the conveying means 1 end up arranged above the central part PC of the sheet P resting on the conveyor belt 2 and so that the sheet P with the articles A arranged on the central part PC thereof can be retained by suction by the vacuum conveyor belt 2 and fed in the travel direction shown by the arrow E in FIG. 2, which may preferably be the same direction as shown by the arrow D in FIG. 1; folding means 4 (better shown in FIG. 3), which are arranged and configured with respect to the conveyor belt 2 so as to be able to meet and fold the side parts PL1, PL2 of the sheet P, which project laterally from the conveyor belt 2.

Figure 3:
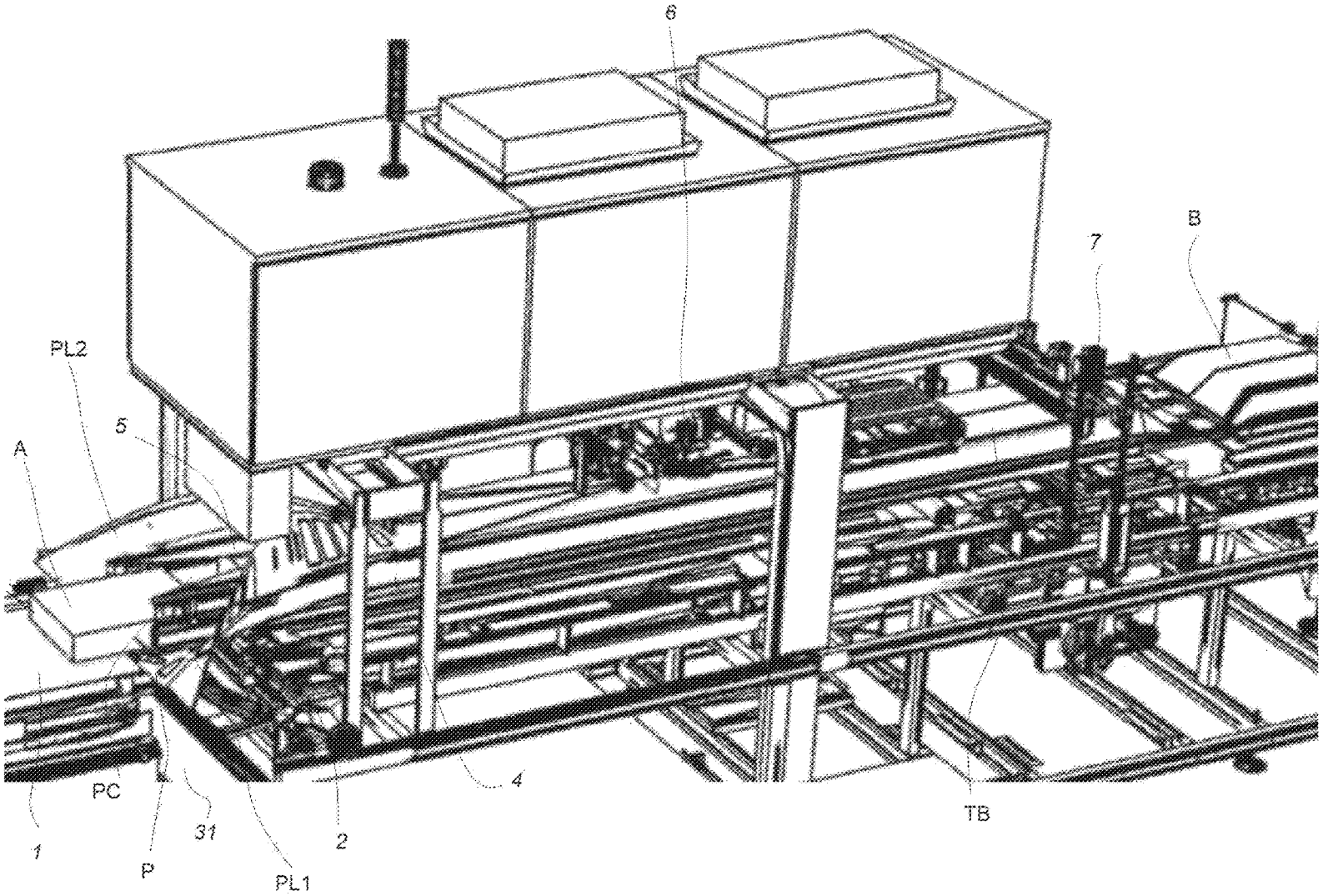
FIG. 3 shows, schematically, an enlargement of the detail shown in the box K in FIG. 1.
Figure 5:
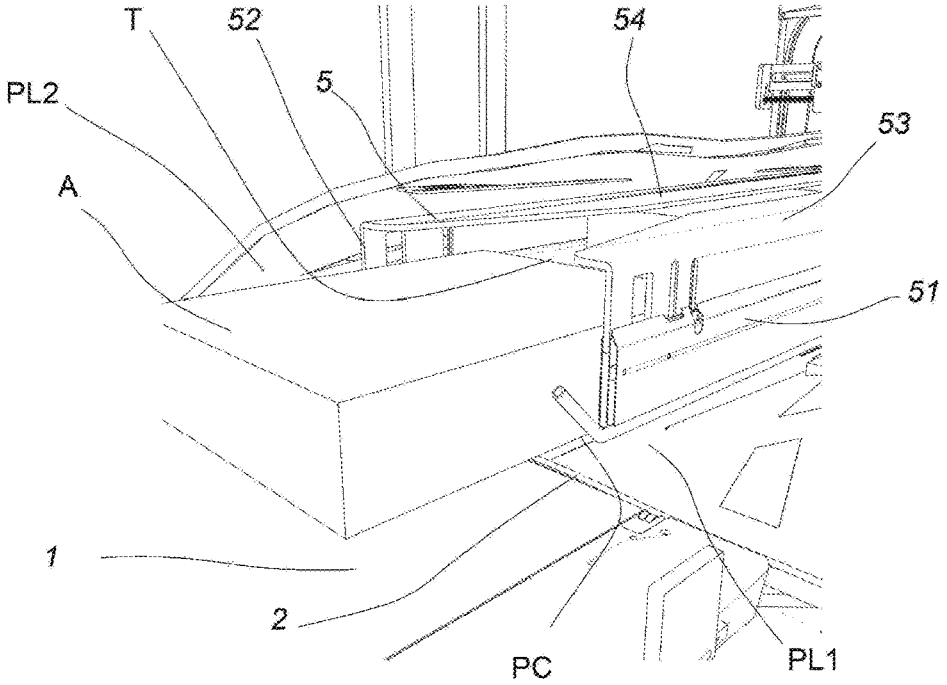
FIG. 5 shows, schematically, a perspective view of a detail of the machine in the area where the initial step consisting of wrapping the sheet around a moving article takes place.

According to a preferred aspect of the invention and with particular reference to FIGS. 3 and 5, the machine M comprises a structure 5 associated with the conveyor belt 2 and shaped so as to define a tunnel T for the passage of the articles A conveyed by the conveyor belt 2 above the central part PC of the sheet P, with the folding means 4, which are shaped and configured so as to meet the lateral parts PL1, PL2 of the sheet P, which are protruding laterally from the conveyor belt 2 during the feeding thereof, and fold the side parts PL1, PL2 of the sheet P around the structure 5 shaped like a tunnel T so that the two side flaps L1, L2 of the sheet P overlap and form a sheet tube TB, which is wrapped around the structure 5 shaped like a tunnel T.

In particular, the structure 5 shaped like a tunnel T is made so that the tunnel T defines a passageway for the articles A whose height with respect to the conveyor belt 2 is such that articles A with different sizes and heights, for example individual magazines, magazines piled together, boxes containing products, etc. can be conveyed within the said tunnel.

Furthermore, the folding means 4 are arranged, with respect to the conveyor belt 2 and with respect to the structure 5 shaped like a tunnel T, so as to meet the lateral parts PL1, PL2 of the sheet which is protruding from the sides of the conveyor belt 2, so as to fold them around the walls of the tunnel T and to form a sheet tube TB containing articles with different sizes and heights. In this way, with a single structure and a single machine M configuration, it is possible to wrap the sheet around articles with different sizes and heights which are moving along the conveyor belt.

Figure 10:
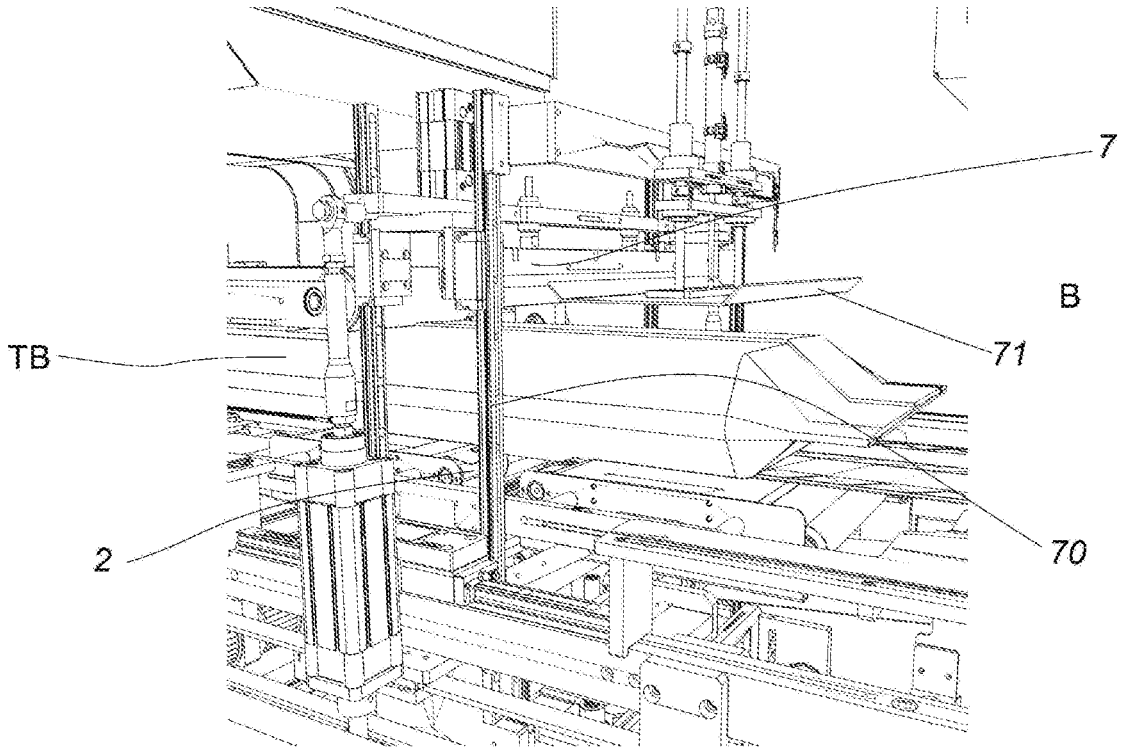
FIG. 10 shows, schematically, a partial perspective view of the compression and cutting means for closing and cutting the sheet wrapped, in a tube-like manner, around an article so as to form a bag.

Furthermore, the machine M comprises first glue application means 6 (FIG. 6), which are positioned above the structure 5 shaped like a tunnel T and which are configured to apply glue to one of the two edges L2 of the sheet P (consisting of the lateral parts PL1, PL2) before their superposition above the tunnel structure; compression and cutting means 7 (FIG. 10), which are positioned downstream of the structure 5 shaped like a tunnel T, at a break in the conveyor belt 2 and which can be activated to clamp the sheet tube TB, first at the front and then at the rear (in front of the following article) with respect to the position of an article A inside the sheet tube TB, to glue and cut the sheet P, thus obtaining a bag B containing an article therewithin. According to a preferred aspect of the invention, these means for compressing and cutting the sheet can be conveyed in the sheet travel direction E and also in the opposite direction, so as to be able to accompany the article A during the compression and cutting step (allowing uninterrupted feeding of the sheet and of the articles) and to return to the initial position while not engaged with the sheet, so as to resume the cycle with the next article. For example, the compression and cutting means 7, which are per se commonly known, can be mounted on a movable undercarriage 70. The means may be a suitably shaped clamp, shown in FIG. 10, which can be lowered onto the conveyor belt 2 at the ends of the bags to be formed, and they can be equipped with a central blade.

According to a preferred aspect, in association with the compression and cutting means 7, evacuation means 71 are envisaged for removing the air from the bag being formed. Their action reduces the air content in the bag before the said bag is sealed completely and separated from the tube TB. According to one embodiment, the said means consist of a suitably sized press 71, located downstream of the compression and cutting means 7. Before the action of the cutting means which seals the second end of the bag, the press is lowered and compresses the bag being formed (a first end is already sealed, as in FIG. 9, which is the condition immediately prior to the action of the air evacuation means) against the article with suitable pressure, so as to cause the reflux of air towards the sheet tube TB, reducing the air content thereof at the bag being formed. Immediately afterwards, the compression and cutting means 7 are activated, and the bag is sealed and separated, with an air content which is such that there is no risk of the bag bursting or increasing in volume. The pressure applied by the press can be adjusted by predetermining the stroke or pressure applied to the bag in a commonly known way (using sensors or other means), in order to cause the air to escape without damaging the article or the wrapping sheet. Advantageously, the evacuation means can be mounted on the same undercarriage 71 as the compression and cutting means 7. Other systems may be provided. The evacuation of the air thus achieved prior to sealing is particularly advantageous with respect to commonly known systems, such as those entailing the perforation of the bag, which is commonly practiced with plastic bags. Indeed, perforation of a paper material such as that used by the machine according to the present invention, while adoptable if deemed appropriate, tends to weaken the bag, leaving it more likely to tear. In this way, however, it becomes possible to use different materials, such as paper materials.

In order for the ends of the bag to be sealed by compression, some glue needs to have been applied to sheet P, inside the already formed tube TB. In particular, the glue must be placed between one article and the next in order to seal the ends of the two bags that are separated upon cutting. For this purpose, second glue application means are envisaged, which are suitable for applying glue to the surface of the sheet P which will be facing the articles and will form the internal surface of the tube TB. Preferably, the said means apply the glue before the tube is formed, more preferably before feeding the sheet to the conveyor belt 2. The glue is applied in relation to the position and size of the articles, which are appropriately measured, so that the articles are appropriately deposited on the sheet, by the conveyor, between one glue application point and the next.

Figure 9:
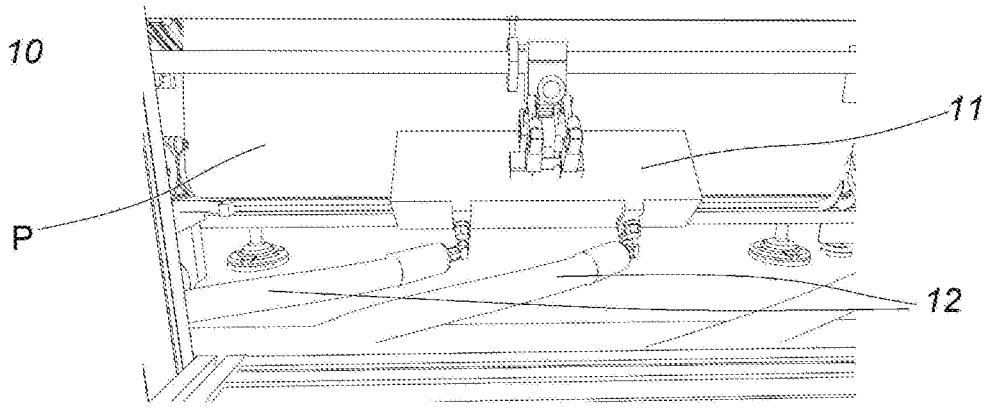
FIG. 9 shows, schematically, a partial perspective view of second means for applying glue to the sheet.

With reference to FIG. 9, the said second glue application means 10 comprise a spraying device 11, which is suitable for spraying glue onto the surface of the sheet inside the tube to be formed, as stated above. The said second means can be advantageously positioned at the end of the feed and return means 31. They are preferably designed to spray one or preferably two strips of glue transversally to the sheet travel direction, preferably in the central part PC of the said sheet. For example, the spraying device 11 may be supplied with glue from the tubes 12 and feature a series of spray nozzles suitably oriented towards the sheet P, so as to all spray the glue at once along the entire area of the sheet P concerned, and the sheet P can keep moving during the glue application step.

The machine is therefore able to wrap a sheet around different articles, with different sizes and heights, and to obtain bags containing individual articles therewithin, without it being necessary to stop the machine and remove and refit components.

Figure 4:
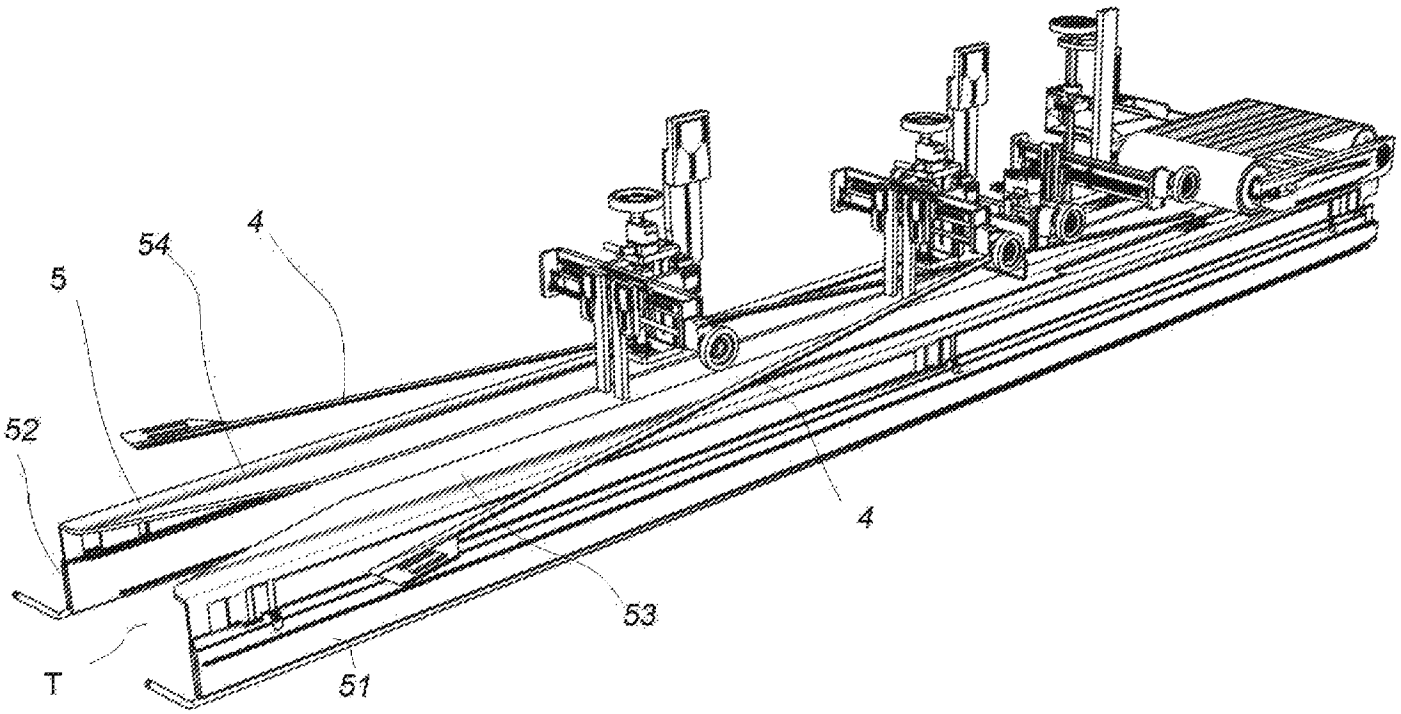
FIG. 4 shows, schematically, a perspective view of certain significant components of the machine in FIG. 1.
Figure 7:
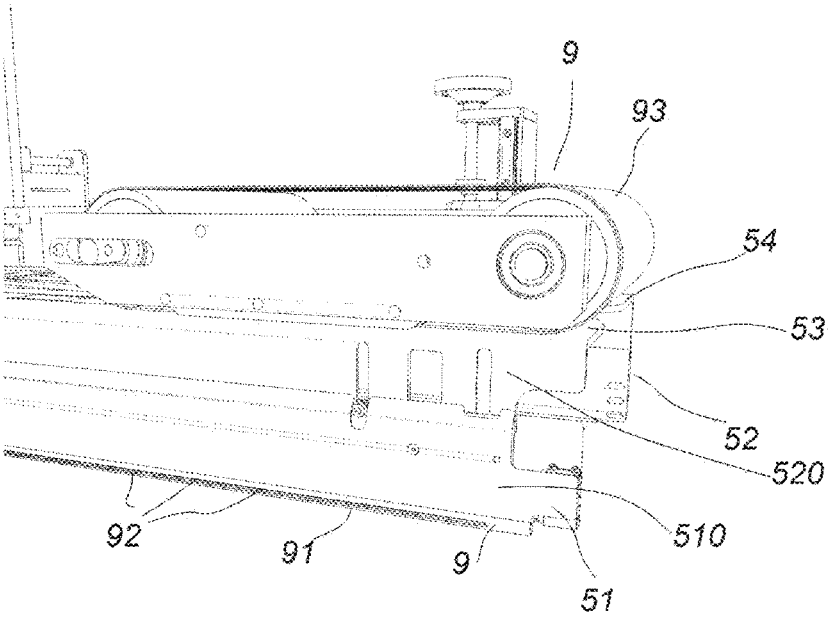
FIG. 7 shows, schematically, a partial perspective view of other particular components of the machine.
Figure 8:
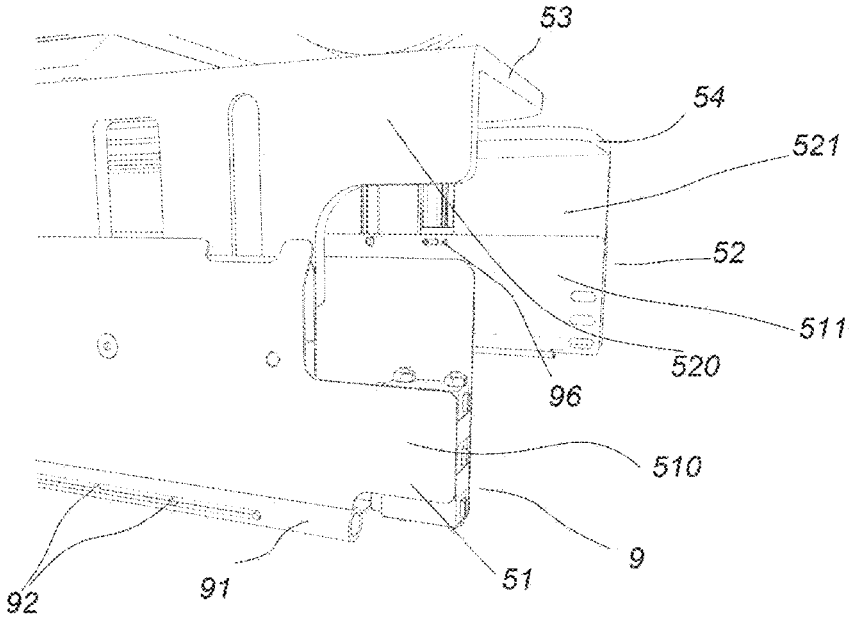
FIG. 8 shows, schematically, a partial perspective view of further parts of the machine.

With reference to FIGS. 4 and 5, according to a preferred aspect, the structure 5 shaped like a tunnel T comprises side walls 51, 52 which are arranged along the sides of the conveyor belt 2 and at least one upper wall 53, 54, between the side walls 51, 52, while the folding means 4 are configured to fold the side parts PL1, PL2 of the sheet P around the side walls 51, 52 and around the upper wall 53, 54 of the structure 5 shaped like a tunnel T so that the two side edges L1, L2 of the sheet P overlap and form the sheet tube TB wrapped around the side and upper walls of the structure 5 shaped like a tunnel T. With reference to FIGS. 7 and 8, advantageously, the lateral walls 51, 52 of the structure 5 shaped like a tunnel T may be made in such a way as to include a fixed lower part 510, 511 and a movable upper part 520, 521 which is mounted with the possibility of moving over the lower part 510, 511 and which supports the upper wall 53, 54. In this way, the position of the upper part 520, 521 of the side walls 51, 52 with respect to the lower part 510, 511 can be adjusted and altered to change the distance between the upper wall 53, 54 and the conveyor belt 2 and therefore change the height of the tunnel T according to the different actual heights of the articles which have to be wrapped by the sheet.

Another preferred aspect of the machine M according to the invention, with particular reference to FIGS. 7 and 8, consists in the fact that it comprises means 9 for creating an air cushion between the sheet tube TB and the structure 5 shaped like a tunnel T. This expedient prevents sliding and therefore friction between the sheet P (and in particular the tube TB that is being formed from it) and the walls of the structure 5 shaped like a tunnel T. According to the particular embodiment shown in the figures, the means 9 for creating an air cushion may comprise ducts 91, connected to a source of compressed air and endowed with a series of holes 92 for the passage of air. The ducts 91 are arranged so as to direct jets of air coming out of the holes 92 towards parts of the sheet P folded against the structure 5 shaped like a tunnel T. For example, these ducts 91 can be arranged along at least part of the two side walls 51, 52 of the structure 5 shaped like a tunnel T.

Furthermore, the means 9 for creating an air cushion may also comprise a suction belt 93, wound in a closed loop and positioned above the structure 5 shaped like a tunnel T so as to hold, by suction, the parts of the sheet P folded over the structure 5 shaped like a tunnel T, the said belt being used to guide the sheet P synchronously with the travel of the conveyor belt 2. According to a further advantageous aspect, the machine M may comprise photo-detecting means 96 arranged along the structure T to detect the passage of the articles A inside the tunnel T and detect the distance between the articles A, and can be configured so that the heat-sealing and cutting means 7 remain inoperative when the photo-detecting means 96 detect that the distance between two consecutive articles is less than a minimum preset distance. This prevents damage to articles that are too close to each other, resulting in insufficient space for the operation of compression and cutting means 7.

Figure 6:
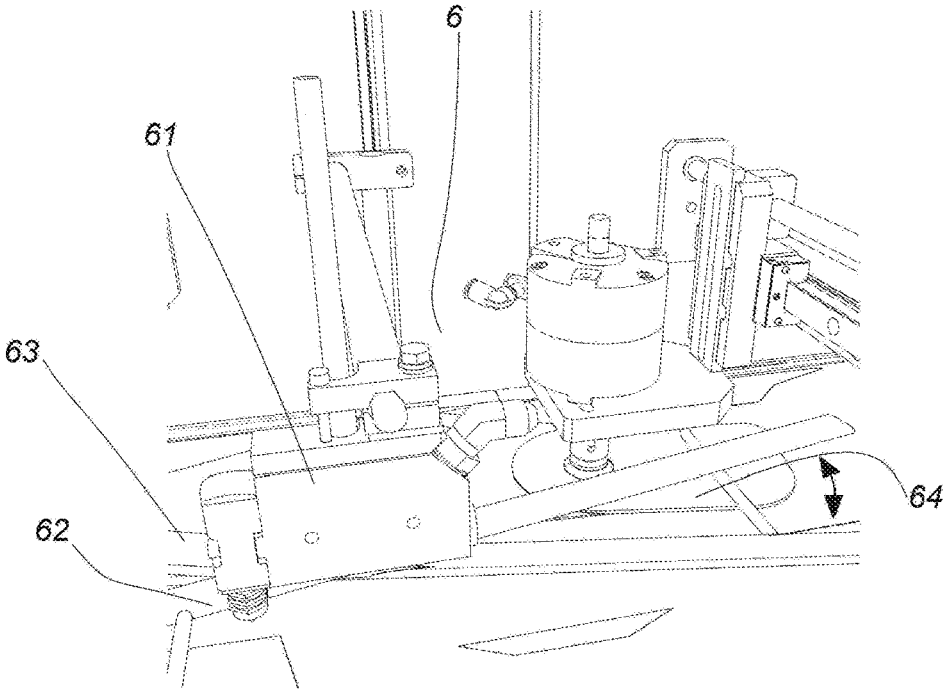
FIG. 6 shows, schematically, the first means for applying glue along the side flaps.

With particular reference to FIG. 6, according to a preferred embodiment, the first glue application means 6 comprise at least one glue dispenser 61, fixed abutment elements 62, 63, arranged downstream of the dispenser 61 with respect to the travel direction E of the sheet P, in order to meet the edges L1, L2 of the sheet P overlapping at the top and facilitate the adhesion thereof and at least one mobile abutment element 64 which can be activated, in the event that the conveyor belt 2 stops, so that it is positioned on top of the two overlapping edges L1, L2 of the sheet P and keep them overlapping and therefore keep the tube TB sealed.

The machine M therefore comprises suction elements arranged below the conveyor belt 2 so that the conveyor belt 2 holds—by means of suction—the central part PC of the sheet P positioned thereupon during the movement of the sheet P in the travel direction E.

As can be seen in FIG. 1, an article loading station 8 may be envisaged which is positioned at an initial part of the conveying means 1 and equipped with identifying means 81 configured to detect and identify an identification code applied to articles A.

Finally, according to a further preferred aspect of the invention, the machine M may comprise detecting means 82 arranged along the conveying means 1 and configured to measure the height of the articles A, and may be configured so that the conveying means 1 are stopped when the detecting means 82 detect the passage of an article which is greater in height than the tunnel T. Printing means may be envisaged, if desired, in particular for the side of the sheet which will be the external part of the tube and bags. These printing means may be placed at the feeding and return means 31.

Downstream of the compression and shear means, if desired, further processing components may be positioned, such as, for example, a labeller, which can print labels according to the data read from the identification code.

With the machine M according to the present invention, the presence of the tunnel-shaped structure makes it also possible to use shock-absorbing wrapping sheets. According to a preferred aspect, a sheet formed of at least two layers of paper, one smooth and one embossed (so as to feature raised and recessed elements) and glued to the first layer (so as to form a shock-absorbing structure). Preferably, if there are only two layers as seen above, the embossed layer will be facing the inside of the tube, in contact with the articles to be packaged. Other layers may also be featured, for example the embossed layer may be sandwiched between two smooth layers. The embossing may feature recesses with a circular base with a spacing therebetween ranging from 0.3 and 10 mm, for example 0.5 mm. Shock-absorbing sheets of this kind are known and different types are commonly produced, for example featuring different numbers of layers and different sized embossing, and are commonly used to wrap objects to be packaged, to protect surfaces, as vibration-damping padding. A person skilled in the art will be able to choose the type that best reconciles different needs, such as flexibility, lightweight design, affordability, and protection requirements.

The invention claimed is:

1. A packaging machine designed to wrap a sheet around articles to form bags containing individual articles, comprising:

conveying means, configured to receive and convey articles to be wrapped with the said sheet in a conveying direction;

a vacuum conveyor belt arranged consecutively to the conveying means;

a sheet feeding station, comprising a reel onto which the said sheet is wound and feeding and return means for feeding the sheet between the conveying means and the conveyor belt, transversely to the conveying direction of the articles, and for arranging the sheet with a central part thereof resting on the conveyor belt and with parts at a side of the central part protruding laterally from the conveyor belt, so that the articles conveyed by the conveying means end up arranged above the central part of the sheet resting on the conveyor belt and so that the sheet with the articles arranged on the central part thereof can be retained by suction by the vacuum conveyor belt and fed in a travel direction;

folding means, arranged and configured with respect to the conveyor belt so as to be able to meet and fold the side parts of the sheet which project laterally from the conveyor belt;

a structure associated with the conveyor belt and shaped so as to define a tunnel for the passage of the articles conveyed by the conveyor belt above the central part of the sheet, with the folding means, which are shaped and configured so as to meet the lateral parts of the sheet, which are protruding laterally from the conveyor belt during the feeding thereof, and fold the side parts of the sheet around the structure shaped like a tunnel so that the two side flaps of the sheet overlap and form a sheet tube, which is wrapped around the structure shaped like a tunnel;

first glue application means, positioned above the structure shaped like a tunnel and configured to apply glue to one of the two flaps of the sheet before they are overlapped;

compression and cutting means positioned downstream of the structure shaped like a tunnel, at a break in the conveyor belt, which can be activated to clamp the sheet tube, first at the front and then at the rear with respect to the position of an article inside the sheet tube, to seal and cut the sheet, obtaining a bag containing the said article therewithin; and second glue application means designed to apply glue to a side of the sheet which will be the side of the said sheet tube facing inwards.

2. The machine according to claim 1, wherein the structure shaped like a tunnel comprises side walls which are arranged along the sides of the conveyor belt and at least one upper wall, between the side walls, and in which the folding means are configured to fold the side parts of the sheet around the side walls and around the upper wall of the structure shaped like a tunnel so that the two side edges of the sheet overlap and form the sheet tube wrapped around the structure shaped like a tunnel.

3. The machine according to claim 2, wherein the side walls of the structure shaped like a tunnel comprise a fixed lower part and a mobile upper part which is mounted—with the possibility of travelling—on the lower part and which carries the at least one upper wall so that the position of the upper part with respect to the lower part may be adjusted and varied so as to vary the distance of the upper wall from the conveyor belt and therefore vary the height of the tunnel.

4. The machine according to claim 1, further comprising means for creating an air cushion between the sheet tube and the structure shaped like a tunnel.

5. The machine according to claim 4, wherein the means for creating an air cushion comprise ducts, connected to a source of compressed air and endowed with a series of holes for the passage of air, the said ducts being arranged so as to direct jets of air coming out of the holes towards parts of the sheet folded against the structure shaped like a tunnel.

6. The machine according to claim 4, wherein the means for creating an air cushion comprise a suction belt wound in a closed loop and positioned above the structure shaped like a tunnel so as to hold, by suction, the parts of the sheet folded over the structure shaped like a tunnel, the said belt being used to guide the sheet synchronously with the travel of the conveyor belt.

7. The machine according to claim 1, further comprising photo-detecting means arranged along the structure shaped like a tunnel and configured to detect the passage of the articles inside the tunnel and detect the distance between the articles, wherein the heat-sealing and cutting means are configured so as to remain inoperative when the photo-detecting means detect that the distance between two consecutive articles is less than a minimum preset distance.

8. The machine according to claim 1, wherein the first glue application means comprise at least one glue dispenser, fixed abutment elements arranged downstream of the dispenser with respect to the travel direction of the sheet in order to meet the edges of the sheet overlapping at the top and facilitate the adhesion thereof and at least one mobile abutment element which can be activated, in the event that the conveyor belt stops, so that at least one mobile abutment element is positioned on top of the two overlapping edges of the sheet and keep them overlapping and therefore keep the sheet tube sealed.

9. The machine according to claim 1, further comprising suction elements arranged below the vacuum conveyor belt so that the vacuum conveyor belt holds—by means of suction—the central part of the sheet positioned thereupon during the movement of the sheet in the travel direction.

10. The machine according to claim 1, further comprising an article loading station positioned at an initial part of the conveying means and equipped with identifying means configured to detect and read an identification code applied to the articles.

11. The machine according to claim 1, further comprising detecting means arranged along the conveying means and configured to measure the height of the articles, wherein the conveying means are configured to be stopped when the detecting means detect the passage of an article which is greater in height than the tunnel.

12. The machine according to claim 1, wherein the said second glue applying means are able to apply glue in strips which are transversal to the sheet travel direction.

13. The machine according to claim 1, wherein the said second glue applying means are positioned upstream of the feeding point for the said sheet to the conveyor belt, in particular at the feeding and return means.

14. The machine according to claim 1, further comprising means for evacuating the air from the bag being formed, designed to act in cooperation with the compression and cutting means and which is designed to compress the sheet tube against the article, before sealing and detaching the bag from the tube.

15. A packaging method in which articles to be packed are wrapped, by means of a machine according to claim 1, in a sheet comprising at least two layers of paper, one of which is smooth and one of which is embossed and glued onto the smooth layer.

16. The method according to claim 15, wherein the smooth layer is the outer surface of the sheet tube and the bags formed.

* * * * *